US006973899B2

(12) United States Patent
Warfel et al.

(10) Patent No.: US 6,973,899 B2
(45) Date of Patent: Dec. 13, 2005

(54) STRATIFIED AIR SCAVENGED TWO-CYCLE ENGINE WITH AIR FLOW

(75) Inventors: Paul Warfel, Texarkana, TX (US); Roy M. Perryman, Nash, TX (US); Rodney Tynes, Shreveport, LA (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 10/784,366

(22) Filed: Feb. 23, 2004

(65) Prior Publication Data

US 2005/0183678 A1 Aug. 25, 2005

(51) Int. Cl.[7] ..... F02B 33/04
(52) U.S. Cl. ..... 123/73 PP; 123/65 P
(58) Field of Search ..... 123/73 PP, 73 R, 123/65 A, 65 P

(56) References Cited

U.S. PATENT DOCUMENTS 6,085,703 A 7/2000 Noguchi
6,101,991 A * 8/2000 Glover ..... 123/73 PP
6,112,708 A 9/2000 Sawada et al.
6,152,093 A 11/2000 Sawada et al.
6,216,650 B1 4/2001 Noguchi
6,240,886 B1 6/2001 Noguchi
6,289,856 B1 9/2001 Noguchi
6,298,811 B1 10/2001 Sawada et al.
6,367,432 B1 * 4/2002 Araki ..... 123/73 R

* cited by examiner

*Primary Examiner*—Noah P. Kamen
(74) *Attorney, Agent, or Firm*—Pearne & Gordon LLP

(57) ABSTRACT

An SAS two-cycle engine has a cylinder block that has a bore with at least one scavenging port and at least one fresh air port therein. The bore extends to a crankcase. A piston of the engine is located within the bore and separates a combustion chamber of the bore from the crank area and is movable between a first position, in closest proximity to the crank area, and a second position. The air port and the piston are configured such that air may flow from the air port into the combustion chamber of the cylinder when the piston is at the first position. In one example, the scavenging port and the air port have edges that are selectively revealed upon movement of the piston. The air port includes an upper edge, which may be contoured such that only a portion of the upper edge is exposed when the piston is at the first position.

12 Claims, 4 Drawing Sheets

STRATIFIED AIR SCAVENGED TWO-CYCLE ENGINE WITH AIR FLOW

FIELD OF THE INVENTION

The present invention relates to a two-cycle engine, and more particularly relates to a two-cycle engine that has a configuration for fresh air flow into a combustion chamber.

BACKGROUND OF THE INVENTION

A stratified air scavenged (SAS) two-cycle engine produces fewer emissions than a comparable displacement non-SAS two-cycle engine. As such, a SAS two-cycle engine can be very beneficial.

In general, a two-cycle engine directs a fuel mixture from a crank area of the engine to a cylinder block combustion chamber via at least one scavenging channel. The piston itself is used to control the flow of the fuel mixture via cyclic blocking/revealing of at least one scavenging port in a cylinder wall. However, the provision of the fuel mixture occurs as combustion gases are being ported from the engine. Within the SAS configuration, fresh air is utilized in order to minimize or prevent non-combusted fuel mixture from being outwardly ported from the engine along with the combustion gases. The piston itself is again used to control flow of the fresh air via cyclic blocking/revealing of at least one air port in the cylinder wall.

Typically, the cylinder block of an SAS engine tends to be long due to the space required for the air port(s) and associated fresh air passageway(s). In one example, the additional length is 8 mm, however, different additional length amounts are contemplated.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with one aspect, the present invention provides a stratified air scavenged two-cycle engine. A cylinder block of the engine has a cylinder bore therein defined by a cylinder sidewall, which has a scavenging port for fuel mixture delivery and an air port for fresh air delivery. A crankcase of the engine is attached to the cylinder block and has a crank area to which the cylinder bore extends. A piston of the engine is located within the cylinder bore. The piston separates a combustion chamber of the cylinder bore from the crank area and is operably movable between a first position, in closest proximity to the crank area, and a second position. The air port and the piston are configured such that air may flow from the air port into the combustion chamber of the cylinder when the piston is at the first position.

In accordance with another aspect, the present invention provides a stratified air scavenged two-cycle engine. A cylinder block of the engine has a cylinder bore therein defined by a cylinder sidewall, which has a scavenging port for fuel mixture delivery and an air port for fresh air delivery. A crankcase of the engine is attached to the cylinder block and has a crank area to which the cylinder bore extends. A piston of the engine is located within the cylinder bore. The piston separates a combustion chamber of the cylinder bore from the crank area and is operably movable between a first position, in closest proximity to the crank area, and a second position. The scavenging port and the air port have edges that are selectively revealed upon movement of the piston. The air port includes an upper edge which is distally located away from the crank area. The upper edge of the air port is contoured such that only a portion of the upper edge is exposed by the piston when the piston is at the first position.

DESCRIPTION OF EXAMPLE EMBODIMENTS

Figure 1:
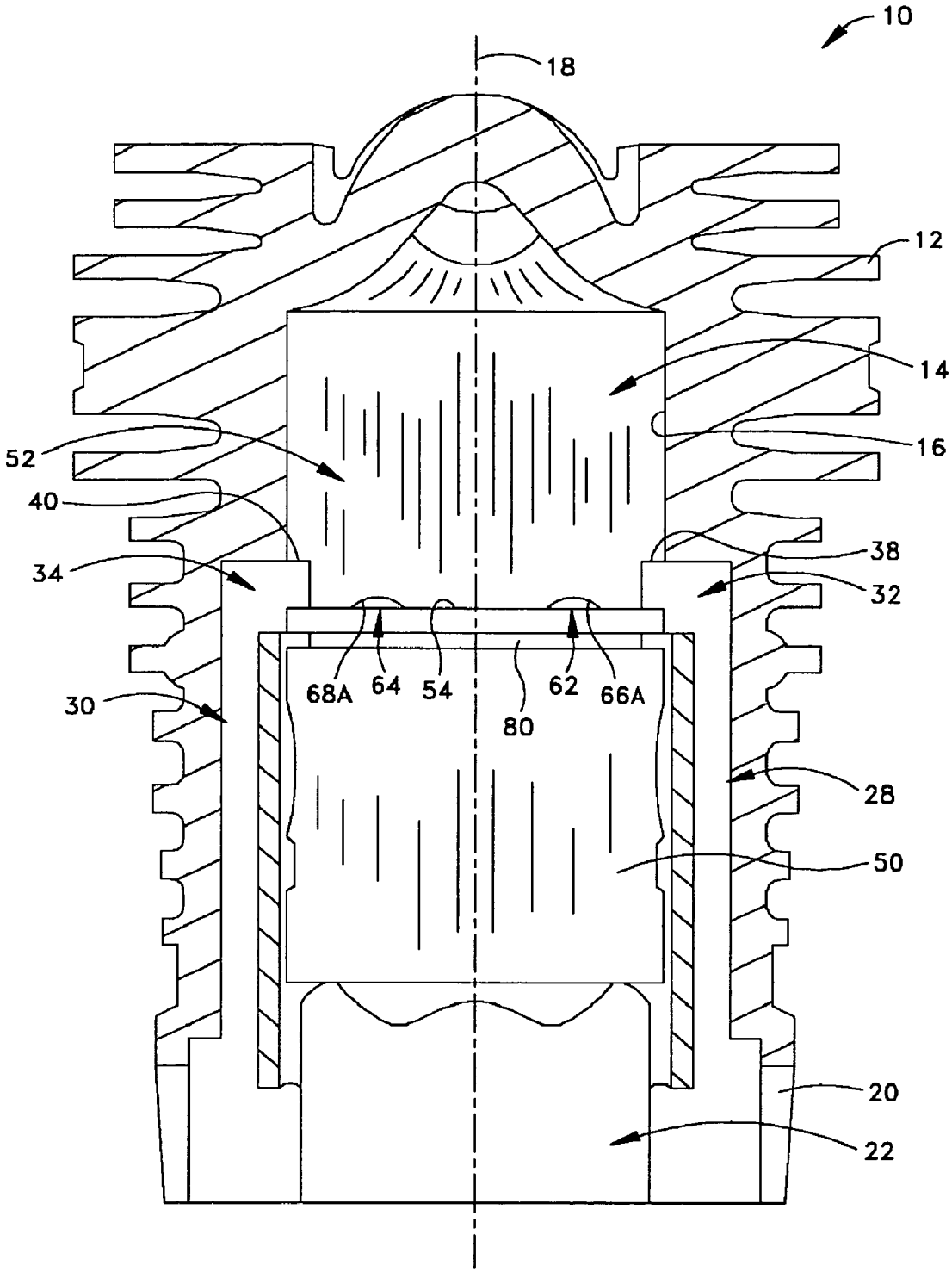
FIG. 1 is a sectional view of an engine in accordance with the present invention, and shows a piston of the engine in a first position relative to a cylinder block of the engine.

The present invention is described herein with reference to the drawings, wherein like reference numerals are used to refer to like elements throughout. It is to be appreciated that the various drawings are not necessarily drawn to scale from one figure to another nor inside a given figure, and in particular that the sizes of the components are arbitrarily drawn for facilitating the reading of the drawings. In the following description, for purposes of explanation, numerous specific details are set forth in order to provide a thorough understanding of the presented examples of the present invention. However, it is to be appreciated that the present invention may be practiced without these specific details.

The present invention relates to a stratified air scavenged two-cycle engine. It is to be appreciated the engine may have many and various components and structures that are not directly related to the present invention. It is to be appreciated that components and structures need not be presented herein. However, it is to be appreciated that any embodiment in accordance with the present invention may have such other components and structures.

Figure 2:
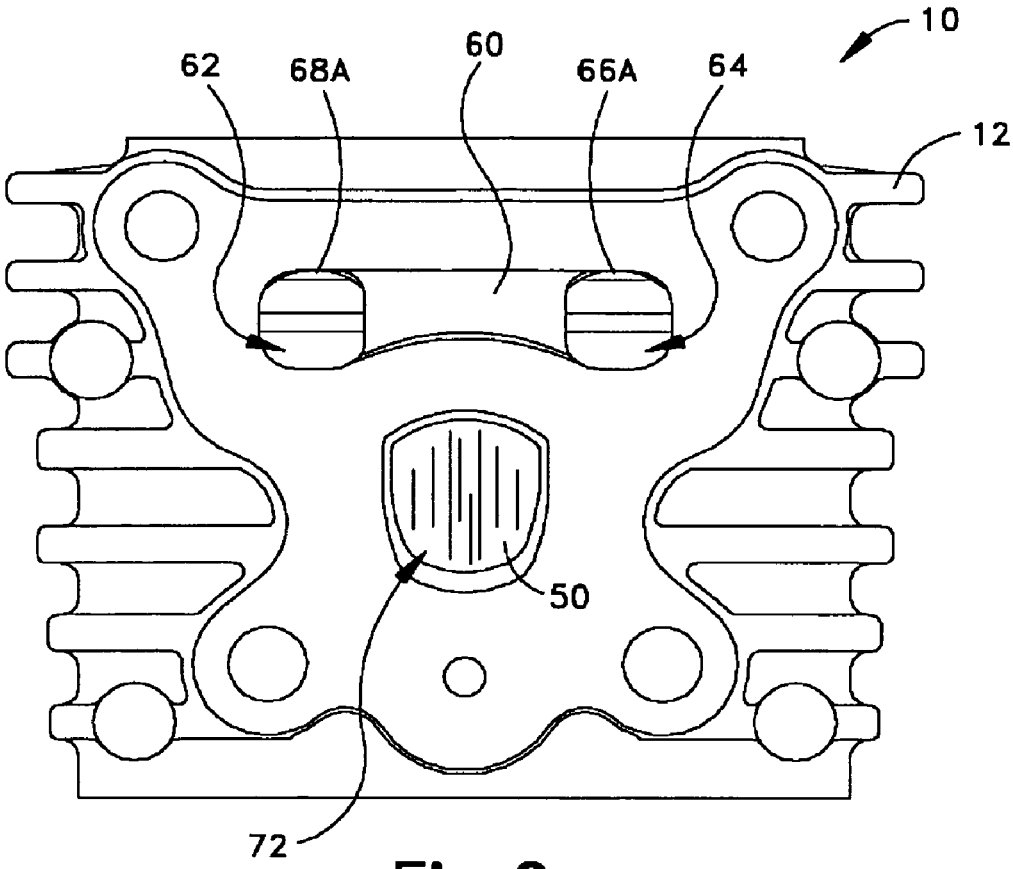
FIG. 2 is an exterior view of a portion of the engine components of FIG. 1.

Referring initially to FIGS. 1 and 2, sectional and exterior views of an example stratified air scavenged two-cycle engine 10 are illustrated. The engine includes a cylinder block 12 that has a cylinder bore 14 therein defined by a cylindrical sidewall 16. A cylinder axis 18 extends along the cylinder bore 14.

A crankcase 20 of the engine 10 is attached to the cylinder block 12 and has a crank area 22 to which the cylinder bore 14 extends. At least one scavenging passage (e.g., 28) extends from the crank area 22 to a scavenging port (e.g., 32) at the cylinder bore 14. In the shown example, two scavenging passages 28 and 30 and two associated scavenging ports 32 and 34 are present. The scavenging passages 28 and 30 are for fuel mixture (e.g., gasoline and air) delivery from the crank area 22 to the cylinder bore 14. It is to be appreciated that the scavenging passages 28 and 30 and the associated scavenging ports 32 and 34 may have a different construction and/or configuration than the shown example.

In pertinent part, each scavenging port (e.g., 32) has an edge (e.g., 38) that is at a furthest extend of the port from the crank area 22, as measured along the cylinder axis 18. Often such edges 38 and 40 are referred to as timing edges. Herein after, the edges 38 and 40 are referred to as upper edges for ease of reference and not to indicate a required orientation.

A piston 50 of the engine 10 is located within the cylinder bore 14. The piston 50 separates a combustion chamber 52 of the cylinder bore 14 from the crank area 22. The piston 50 is operatively connected (e.g., a wrist pin, piston rod, etc., not shown) to a crankshaft (not shown) in the crankcase 20 and is operably movable along the axial extent of the cylinder bore 14 between a first position (shown in FIGS. 1 and 2), in which the piston is in closest proximity to the crank area, and a second position. Often, the first position is referred to as a bottom dead center position. However, for ease of reference herein, the terminology of first and second positions is used.

On the piston 50, a most distal, as measured along the cylinder axis 18 from the crank area 22, surface 54 faces toward the combustion chamber. Herein after, the most distal surface 54 is referred to as the upper surface for ease of reference and not to indicate a required orientation. As will be appreciated by the person of ordinary skill in the art, the volume of the combustion chamber 52, as bounded by the upper piston surface 54, varies when the piston 50 moves.

Also, movement of the piston 50 results is selective blocking and revealing (e.g., uncovering) of the scavenging ports 32 and 34 with respect to the combustion chamber 52. As can be appreciated from FIG. 1, the fuel mixture is delivered to the combustion chamber 52 when the piston 50 is at/near the first position. Specifically, for each scavenging port (e.g., 32), fuel mixture flow can occur when the pertinent portion of the upper surface 54 of the piston 50 is moved closer, as measured along the cylinder axis 18, to the crank area 22 than the upper edge (e.g., 38) of the scavenging port, thus revealing the scavenging port to the combustion chamber 52. Accordingly, the delivery of the fuel mixture to the combustion chamber 52 is responsive to piston movement. Of course, the person of ordinary skill in the art will appreciate that the fuel mixture is ignited (e.g., via a spark plug or the like, not shown) when the piston 50 is at/near the second position, and the ignition of the fuel mixture results in a movement of the piston toward the crank area 22.

The cylinder block 12 includes a fresh air passage way 60 (FIG. 2) that terminates at one or more air ports (e.g., 62) in the cylinder sidewall 16 (FIG. 3) for fresh air delivery. In pertinent part, the shown example has two air ports 62 and 64 that are located at a distance, as measured along the cylinder axis 18, from the crank area 22 that is close to the distance at which the scavenging ports 32 are located from the crank area. However, it is to be appreciated that a different number (e.g., only one) of such air ports could be provided.

In very broad terms, at least one air port (e.g., 62) and the piston 50 (FIG. 1) are configured such that air may flow from the air port into the combustion chamber 52 of the cylinder bore 14 when the piston is at the first position. Specifically, each air port (e.g., 62) has an edge (e.g., 66A) that is at a furthest extend of the port from the crank area 22, as measured along the cylinder axis 18. Herein after, the edges 66A and 68A are referred to as upper edges for ease of reference and not to indicate a required orientation. Movement of the piston 50 results is selective blocking and revealing of the air ports 62 and 64 with respect to the combustion chamber 52.

As can be appreciated from FIG. 1, fresh air is delivered to the combustion chamber 52 when the piston 50 is at/near the first position. Specifically, for each air port (e.g., 62), air flow can occur when the pertinent portion of the upper surface 54 of the piston 50 is moved closer, as measured along the cylinder axis 18, to the crank area 22 than the upper edge (e.g., 66A) of the air port, thus revealing the air port to the combustion chamber 52. Thus, the delivery of the air to the combustion chamber 52 is responsive to piston movement.

Figure 3:
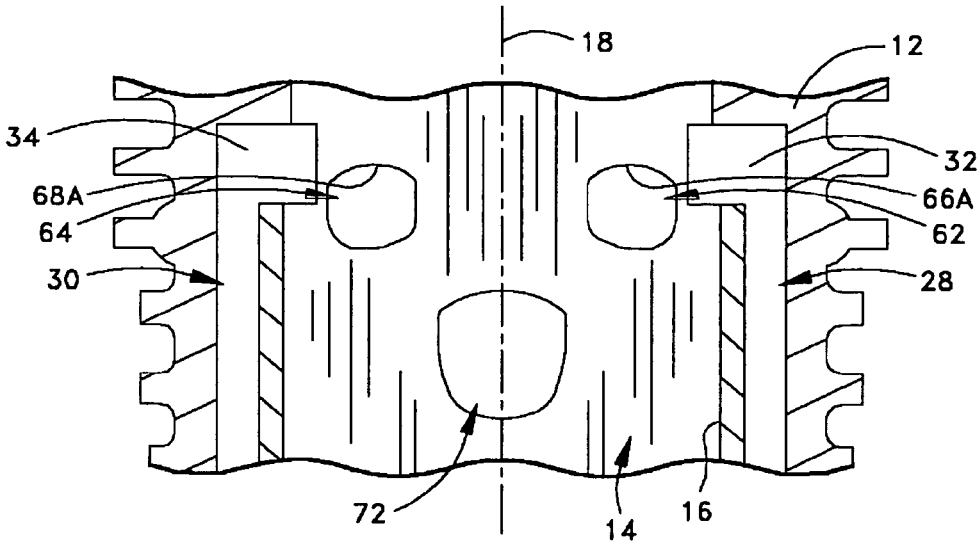
FIG. 3 is a section view of the cylinder block of the engine with the piston removed to show air ports in the cylinder block.

Turning to the details of each air port (e.g., 62) and the associated upper edge (e.g., 66A), the upper edge of the air port is contoured such that only a portion of the upper edge is exposed by the piston 50 when the piston is at the first position. In the example of FIGS. 1–3, the upper edge (e.g., 66A) is rounded such that the center of the upper edge is distal from the crank area 22. Thus, the center is the first portion of the upper edge (e.g., 66A) that is revealed as the piston moves toward the crank, and progressively more of the upper edge is revealed as the piston moves toward the first location.

It is to be appreciated that the amount of the upper edge (e.g., 66A) that is revealed, and thus the amount of the air port (e.g., 62) that is revealed, is dependent upon the construction, configuration, and cooperation of the cylinder block 12 and the piston 50. It is to be noted that initial revealing of the upper edge (e.g., 66A) may occur at a piston location that is spaced away from the location of the piston 50 at the first position. As the piston 50 travels toward the first position (i.e., toward the crank area 22), the amounts of revealed upper edge (e.g., 66A) and revealed air port (e.g., 62) increases.

Figure 4:
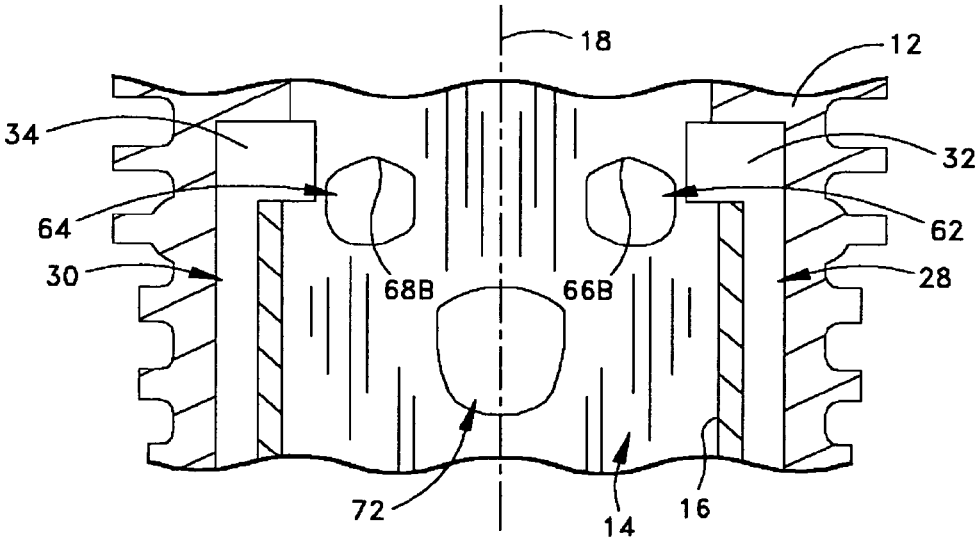
FIG. 4 is a section view similar to FIG. 3 and shows a cylinder block of a second embodiment of the present invention.

It is to be appreciated that the upper edge (e.g., 66A) of the air port (e.g., 62) may have any contour that provides for only part of the upper edge to be initially revealed as the piston 50 moves toward the crank area 22. The example embodiment of FIG. 4 has air ports 62 and 64 with upper edges 66B and 68B that are peaked at the center of the upper edges. The portions of each upper edge (e.g., 66B) on the sides of the center peak are sloped relative to the axis 18 of the cylinder bore 14.

Figure 5:
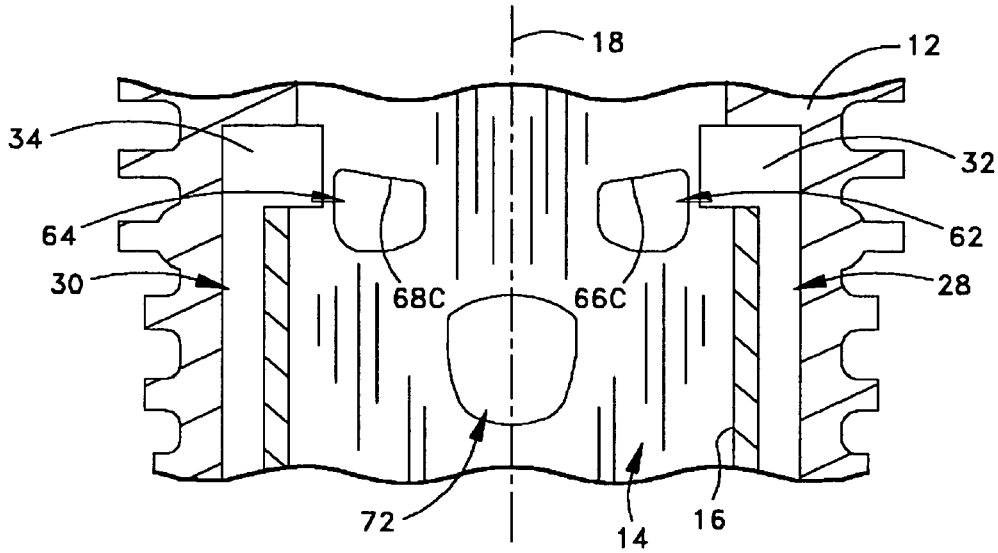
FIG. 5 is a section view similar to FIG. 3 and shows a cylinder block of a third embodiment of the present invention.
Figure 6:
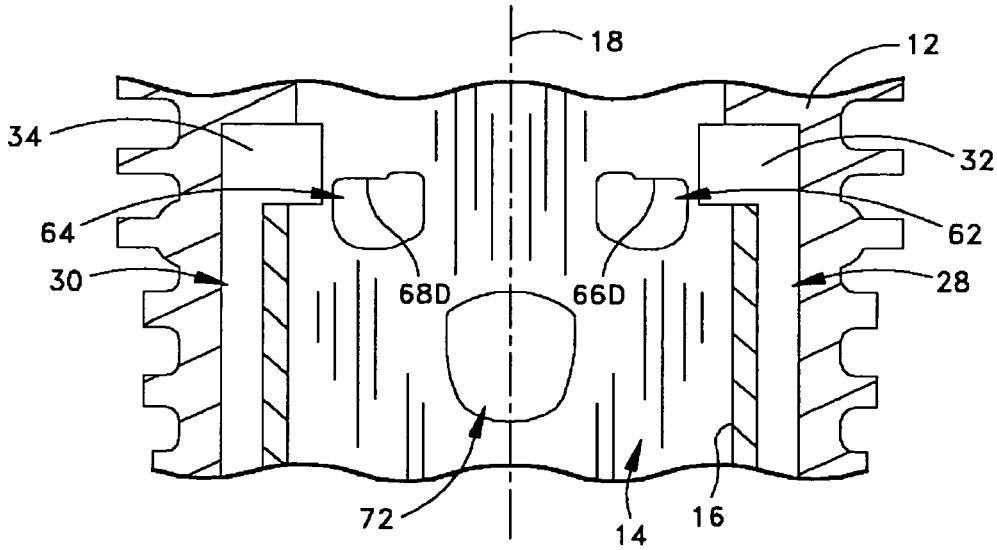
FIG. 6 is a section view similar to FIG. 3 and shows a cylinder block of a fourth embodiment of the present invention.

The example embodiment of FIG. 5 has air ports 62 and 64 that have upper edges 66C and 68C that are angled such that one side of each upper edge is distal from the crank area 22. As such, each upper edge (e.g., 66C) has a continuous slope between the two sides of the air port (e.g., 62). The example embodiment of FIG. 6 has air ports 62 and 64 that each have a notch at the respective upper edge 66D, 68D. Within the shown embodiment, the notch is at one side, however, the notch may be located elsewhere on the upper edge (e.g., 66D). The notch may be considered to be a step. It is to be appreciated that the upper edge (e.g., 66D) may have more than one step and the steps may be progressive.

It is to be appreciated that the air passage 60 and the piston 50 are configured such that air passage 60 may also communicate with the scavenging passages 28 and 30 when the piston 50 is at a location away from the first position. When the piston 50 is away from the first position, fuel mixture (i.e., air and fuel) can flow directly from a port 72 located in the cylinder sidewall 16 into the crank area 22. Typically, such mixture flows occur when the piston 50 is at or near to the second position.

The present invention provides for a reduction in the overall length of the cylinder bore 14 because of cooperation between the cylinder block 12, with the at least one air port (e.g., 62), and the piston 50 as the piston moves toward the first position. In one example, reduced engine size can be achieved via the present invention. Also, in one example, increased power and reduced hydrocarbon emissions are achieved via the present invention. Within one specific example, an increase of 12% in power and a decrease of 16% reduction in emissions, as compared to a comparable engine that does not include the present invention, is obtainable. Such a comparable engine contained non-contoured (e.g., box-shaped) ports.

Other beneficial results may also be obtained. For example, travel of a piston ring (not shown), which is located with a ring groove 80, over the air ports 62 and 64 is improved. The improvement may be especially poignant for upper edge contours that are rounded. The contoured upper edge may also be associated with a reduction in inlet tract noise.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed:

1. A stratified air, scavenged two-cycle engine comprising:

a cylinder block having a cylinder bore therein defined by a cylinder sidewall, which has a scavenging port for fuel mixture delivery and an air port for fresh air delivery;

a crankcase attached to the cylinder block and having a crank area to which the cylinder bore extends; and a piston located within the cylinder bore, the piston separating a combustion chamber of the cylinder bore from the crank area and being operably movable between a first position, in closest proximity to the crank area, and a second position;

the air port and the piston being configured such that air may flow from the air port into the combustion chamber of the cylinder when the piston is at the first position;

wherein the air port has an edge distal from the crank area that is contoured such that only a portion of the edge is exposed by the piston when the piston is at the first position.

2. An engine as set forth in claim 1, wherein the edge has a notch.

3. An engine as set forth in claim 1, wherein the edge has a sloped portion.

4. An engine as set forth in claim 1, wherein the edge has a stepped portion.

5. An engine as set forth in claim 1, including a passage for conveying the fuel mixture to the scavenging port from the crank area.

6. An engine as set forth in claim 1, wherein the air port and the piston are configured such that the air port is fluidically connected to the scavenging passages and crank area when the piston is at a location away from the first position.

7. A stratified air scavenged two-cycle engine comprising:

a cylinder block having a cylinder bore therein defined by a cylinder sidewall, which has a scavenging port for fuel mixture delivery and an air port for fresh air delivery;

a crankcase attached to the cylinder block and having a crank area to which the cylinder bore extends; and a piston located within the cylinder bore, the piston separating a combustion chamber of the cylinder bore from the crank area and being operably movable between a first position, in closest proximity to the crank area, and a second position;

wherein the scavenging port and the air port have edges that are selectively revealed upon movement of the piston, and the air port includes an upper edge which is distally located away from the crank area, the upper edge of the air port is contoured such that only a portion of the upper edge is exposed by the piston when the piston is at the first position.

8. An engine as set forth in claim 7, wherein the edge has a notch.

9. An engine as set forth in claim 7, wherein the edge has a sloped portion.

10. An engine as set forth in claim 7, wherein the edge has a stepped portion.

11. An engine as set forth in claim 7, including a passage for conveying the fuel mixture to the scavenging port from the crank area.

12. An engine as set forth in claim 7, wherein the air port and the piston are configured such that the air port is fluidically connected to the scavenging passages and crank area when the piston is at a location away from the first position.

* * * * *